US007704366B2

(12) United States Patent
Pearson et al.

(10) Patent No.: US 7,704,366 B2
(45) Date of Patent: Apr. 27, 2010

(54) PRETREATMENT OF MAGNESIUM SUBSTRATES FOR ELECTROPLATING

(76) Inventors: Trevor Pearson, 8 Cricketeers Meadow, Cradley Heath, West Midlands (GB) B64 7HR; Maria Del Mar Cordero-Rando, Flat 2, Hunscote House, Hunscote Close, Shirley, Solihull (GB) B90 2NH ( * ) Notice: Subject to any disclaimer, the term of this patent is extended or adjusted under 35 U.S.C. 154(b) by 1288 days.

(21) Appl. No.: 11/205,516

(22) Filed: Aug. 17, 2005

(65) Prior Publication Data

US 2007/0039829 A1 Feb. 22, 2007

(51) Int. Cl.
*C25D 5/00* (2006.01)
*C25D 5/02* (2006.01)
*C25D 11/30* (2006.01)

(52) U.S. Cl. ..... 205/102; 420/411

(58) Field of Classification Search ..... 205/102; 420/411

See application file for complete search history.

(56) References Cited

U.S. PATENT DOCUMENTS 2,288,995 A 7/1942 De Long
2,526,544 A 10/1950 De Long
2,811,484 A 10/1957 De Long
3,637,441 A * 1/1972 Lyle et al. ..... 75/249
4,349,390 A 9/1982 Olsen et al.
5,240,589 A 8/1993 Bartak et al.

FOREIGN PATENT DOCUMENTS

JP 2002-212662 * 7/2002

* cited by examiner

*Primary Examiner*—Harry D. Wilkins, III
*Assistant Examiner*—Zulmariam Mendez
(74) *Attorney, Agent, or Firm*—Carmody & Torrance LLP

(57) ABSTRACT

The present invention relates to a method for depositing an adherent zinc coating onto a zinc-containing magnesium alloy substrate in order to render the surface suitable for electroplating. The coatings are applied from a pyrophosphate-based zinc electrolyte solution containing a small quantity of fluoride ions. Depending on the zinc and aluminum content of the magnesium alloy, the zinc electrolyte solution is applied by immersion deposition or electrolytically.

11 Claims, No Drawings

PRETREATMENT OF MAGNESIUM SUBSTRATES FOR ELECTROPLATING

FIELD OF THE INVENTION

The present invention is directed to an improved method for depositing an adherent zinc coating onto a zinc-containing magnesium alloy substrate in order to render the substrate surface suitable for electroplating.

BACKGROUND OF THE INVENTION

The present invention is directed to an improved method of producing adherent metal coatings on the surface of magnesium/zinc alloy substrates.

Plating on magnesium alloys has been used for a number of years. However, in order to obtain good adhesion of the metallic coating to the magnesium/zinc alloy substrate, numerous processing steps have generally been required.

An example of one process is described in U.S. Pat. No. 4,349,390 to Olsen et al., the subject matter of which is herein incorporated by reference in its entirety. The steps in this process are as follows:

1) Surface preparation by mechanical pretreatment;
2) Degreasing using organic solvents or alkaline cleaning solutions;
3) Activating the surface of the magnesium alloy substrate;
4) Chemical zinc precipitation by immersion plating in an alkali metal pyrophosphate solution containing zinc ions, preferably at temperatures above 60° C.; and
5) Electrolytic metal coating.

Magnesium is a very active metal, and the pickling steps in the above described pretreatment sequences tend to open up any underlying porosity in the magnesium substrate. Thus, although an adherent deposit of copper may be subsequently obtained, the cosmetic appearance and corrosion resistance of coatings applied on top of this copper deposit tend to be very poor.

Traditionally, the only way to obtain plated magnesium articles of good cosmetic appearance and corrosion resistance is to apply a thick layer of copper and mechanically polish the article at this stage to seal any porosity. Subsequently, the coated articles must be re-racked and re-activated before plating with subsequent metals, such as nickel and chromium. This makes the production of plated magnesium articles very expensive, especially as any "polish through" of the copper during the polishing operation will render the article useless.

More recently, magnesium alloys which contain a significant proportion of zinc have been developed. These alloys are claimed to have superior casting qualities and reduced levels of porosity.

The inventors of the present invention have surprisingly found that these alloys can be processed for plating using an etch-free pre-treatment process, which eliminates the need for a pickling or activation stage in the plating process. Thus, the porosity of polished magnesium castings is not opened up and articles of excellent cosmetic appearance and good corrosion resistance can be obtained without any intermediate polishing operations on the copper deposit prior to nickel (or other metal) plating. This has obvious commercial advantages in terms of reducing the number of processing stages necessary to produce a high quality finished article.

Upon further investigation, the inventors of the present invention have also discovered that the presence of zinc in the cast article is not the only factor relevant to the level of adhesion obtained during the etch-free process sequence. Another critical factor for successfully processing the magnesium alloy article is the aluminum content of the magnesium alloy. High zinc alloys tend to have a low aluminum content. Aluminum is added to magnesium alloys to harden the casting and produce grain refinement, but also gives a long freezing range, which may increase casting porosity.

The inventors of the present inventions have found that in order to be able to process castings using the desired "etch-free" process of the invention, the aluminum content of the casting must be controlled. For example, in alloys containing 4% or more of zinc, it is desirable that the aluminum content be less than about 9% and in alloys containing less than 4% of zinc, it is desirable that the aluminum content be less than 6%.

Without wishing to be bound by theory, the inventors believe that this is due to the presence of intermetallic magnesium/aluminum phases precipitated at the surface during cooling from the melt in the casting process. These intermetallic phases then produce micro-galvanic effects during the pre-treatment and plating process which leads to poor adhesion unless pickling and activation stages are employed in order to equalize surface potential.

The inventors have determined that alloys having less than 6% zinc can be processed by applying the zinc coating in an immersion process, with a zinc processing solution containing pyrophosphate, fluoride and zinc. The inventors have also determined that when the alloy contains more than 6% zinc, superior results can be obtained in an electrolytic process, where the application of a cathodic current forces the zinc to deposit from the solution.

SUMMARY OF THE INVENTION

It is an object of the present invention to provide an improved method of obtaining plated magnesium articles of good cosmetic appearance and corrosion resistance.

It is another object of the present invention to investigate the effect of the magnesium alloy composition on the plating conditions used in the process of the invention.

To that end, the present invention is directed to a method of providing an adherent plated deposit on a magnesium alloy article, wherein the magnesium alloy contains about 0-9% aluminum and about 0.2-20% zinc.

In this instance, the method comprising the steps of:

a) cleaning the magnesium alloy article in an alkaline cleaning solution;
b) applying a zinc layer on the cleaned magnesium alloy article by immersion deposition or electrodeposition in a zinc coating solution; and
c) applying a metal coating from an electrolyte solution that is compatible with the zinc coated magnesium surface.

In another embodiment, the present invention is directed to a method of depositing an adherent plated deposit onto a magnesium alloy article, wherein the magnesium alloy article containing about 0-9% aluminum and about 6-20% zinc.

In this instance the method comprises the steps of:

a) cleaning the magnesium alloy article in an alkaline cleaning solution;
b) applying a zinc layer on the cleaned magnesium alloy article by electrodeposition in a zinc coating solution; and
c) applying a metal coating from an electrolyte solution that is compatible with the zinc coated magnesium surface.

In both embodiments, preferably substantially no etching of the magnesium alloy is performed.

DETAILED DESCRIPTION OF THE PREFERRED EMBODIMENTS

The present invention is directed to an improved method of electroplating magnesium alloy castings having an aluminum content of less than about 9%, such that the usual etching and pickling pretreatment stages may be eliminated. The process of the invention enables components to be produced that have excellent cosmetic appearance as well as superior corrosion resistance, without the need for intermediate polishing or buffing stages.

The present invention is directed to a process comprising the following stages:

a) cleaning the magnesium alloy article in an alkaline cleaning solution;

b) applying a zinc layer on the cleaned magnesium alloy article by immersion deposition or electrodeposition in a zinc coating solution; and c) applying a metal coating from an electrolyte solution that is compatible with the zinc coated magnesium surface.

The magnesium alloy preferably contains about 0-9% aluminum and about 0.2-20% zinc.

The zinc coating solution of the invention is an aqueous solution that generally comprises:

an alkali metal pyrophosphate;

a zinc salt; and a water soluble fluoride salt or hydrofluoric acid.

In a preferred embodiment, the alkali metal pyrophosphate is typically present in the zinc coating solution in an amount sufficient to provide about 6 to 270 g/l of pyrophosphate ion, the zinc salt is present in the solution in an amount sufficient to provide about 1 to 40 g/l zinc ions, and the fluoride salt or hydrofluoric acid is present in the solution in an amount sufficient to provide about 2-80 g/l fluoride ions. The zinc coating solution typically has a pH between about 8 and 11.

The present invention is also directed to a method of depositing an adherent plated deposit onto a magnesium alloy article, comprising the steps of:

a) cleaning the magnesium alloy article in an alkaline cleaning solution;

b) applying a zinc layer on the cleaned magnesium alloy article by electrodeposition in a zinc coating solution; and c) applying a metal coating from an electrolyte solution that is compatible with the zinc coated magnesium surface.

In this instance, the magnesium alloy article contains about 0-9% aluminum and about 6-20% zinc.

The magnesium alloy article is cleaned (degreased) using a highly alkaline cleaner, i.e., above pH 10, to avoid any etching of the magnesium surface. The effectiveness of the cleaning process may be enhanced by agitating the cleaning solution, either by mechanical agitation, ultrasonic agitation, or utilizing the gassing action of electrolytic cleaning (preferably cathodic).

The zinc coating solution is applied as a thin layer of zinc from the solution containing an alkali metal pyrophosphate and zinc ions. The solution is operated electrolytically at a current density of 0.5 to 5 amps per square decimeter ($A/dm^2$), more preferably 0.5-2.0 $A/dm^2$, if the zinc content of the alloy is greater than 6%. The inventors have found that this is a necessary step in the processing of these alloys because the zinc in the alloy prevents the formation of a satisfactory zinc coating by simply immersing the component in the solution. However, alloys containing less than 6% zinc can be successfully processed using immersion plating.

The temperature of the zinc coating solution is preferably maintained between about 10-100° C., and more preferably between about 40-65° C.

When processing magnesium alloy articles electrolytically, the immersion time period is generally about 1 to 10 minutes, more preferably from 3 to 7 minutes. When utilizing an immersion plating process, the immersion time period is generally about 1 to 15 minutes, preferably about 2 to 5 minutes.

Finally, the magnesium alloy article is plated in a bath, which is compatible with the zinc coated magnesium article. Exemplary examples include copper or brass from a cyanide electrolyte, zinc from an alkaline electrolyte, and an electroless nickel solutions containing fluoride ions.

One suitable process uses compositions similar to the compositions described in U.S. Pat. No. 2,526,544 to De Long, the subject matter of which is herein incorporated by reference in its entirety.

Following the above referenced steps of the process, further layers of metal, including as nickel and chromium, may be applied to the coated article.

EXAMPLES

Comparative Example 1

A polished cast magnesium tap handle having an alloy composition of 12.5% zinc, 3.3% aluminum, and 0.2% zinc was processed using a conventional pretreatment sequence, as described in U.S. Pat. No. 4,349,390.

The process sequence was as follows:

1. Acetone degrease
2. Rinse
3. Dip in solution containing 10 g/l oxalic acid for 1 minute at ambient temperature
4. Rinse
5. Dip in solution containing 65 g/l potassium pyrophosphate and 15 g/l sodium carbonate for 1 minute at 60° C.
6. Rinse
7. Dip in solution containing 55 g/l zinc sulfate, 150 g/l potassium pyrophosphate, 7 g/l potassium fluoride, and 5 g/l sodium carbonate for 3 minutes at 65° C.
8. Rinse
9. Plate in cyanide copper at 2 $A/dm^2$ for 15 minutes
10. Rinse
11. Plate in bright nickel plating solution at 4 $A/dm^2$ for 20 minutes
12. Rinse
13. Plate in bright chromium plating solution at 10 $A/dm^2$ for 6 minutes
14. Rinse
15. Dry Following this sequence, the component was examined. The adhesion of the coating was very poor with evident blistering. In addition, the cosmetic appearance of the component was very poor, having a "frosted" aspect.

This example illustrates that an immersion plating process does not give good adhesion levels when used with high zinc magnesium alloys.

Comparative Example 2

A polished cast magnesium handle having the same alloy composition as Comparative Example 1 was processed using the same processing sequence, except for Step 7. For this step, the same solution composition was used, but the coating was applied by electrolysis rather than by immersion coating. The conditions used for electrolysis were a current density of 1 A/dm$^2$ for 5 minutes at a temperature of 60° C.

After processing, the component was examined. In this instance, the adhesion of the deposit was excellent with no apparent blisters and no lifting of the deposit following cutting and filing. However, the cosmetic appearance of the component was still very poor, demonstrating "frosting", roughness, and pitting.

This example illustrates that the electrolytic application of the zinc layer gives good deposit adhesion, but the activation and pickling stages give poor cosmetic appearance due to etching of the magnesium opening underlying porosity in the casting.

Neither of the components produced by comparative examples 1 and 2 were suitable for commercial applications.

Example 1

A polished cast magnesium handle having the same alloy composition as that used in Comparative Examples 1 and 2 was processed using the following sequence:

1. Alkaline cleaning using a solution containing 25 g/l sodium hydroxide, 25 g/l sodium gluconate using a voltage of 6V for 3 minutes at a temperature of 65° C.
2. Rinse
3. Plating in solution containing 55 g/l zinc sulfate, 150 g/l potassium pyrophosphate, 7 g/l potassium fluoride, and 5 g/l sodium carbonate for 5 minutes at 60° C. using a current density of 1 A/dm$^2$
4. Rinse
5. Plate in cyanide copper at 2 A/dm$^2$ for 15 minutes
6. Rinse
7. Plate in bright nickel plating solution at 4 A/dm$^2$ for 20 minutes
8. Rinse
9. Plate in bright chromium plating solution at 10 A/dm$^2$ for 6 minutes
10. Rinse
11. Dry Following the processing, the component was examined. In this case, the deposit adhesion was excellent and no blistering was evident, even after heating to 150° C. for 1 hour and quenching in cold water. The cosmetic appearance of the component was excellent, having a mirror bright finish with no pits, pores, or frosting. The overall condition of the sample was acceptable for commercial use.

Comparative Example 3

A plate of cast AZ91 magnesium alloy having a composition of 9% aluminum and 1% zinc was processed using the sequence described in Example 1. Following processing, the component was examined, and extensive blistering of the deposit was noted. This example illustrates that alloys containing high aluminum and low zinc content will not work using the etch-free processing sequence described in the present invention.

Example 2

A magnesium alloy casting having a composition of 0.5% zinc and less than 1% aluminum was processed using the sequence described in Example 1.

Following processing, the component was examined. Deposit appearance and adhesion were excellent.

Example 3

A magnesium alloy casting having a composition of 0.5% zinc and less than 1% aluminum was processed using the sequence described in Example 1 except that the zinc coating in step 3 was applied without the use of applied current. In this case, the adhesion and appearance were again determined to be excellent.

Example 4

Magnesium alloys having various compositions were treated by the sequence described in Example 1, both with and without the use of applied current during the zinc deposition stage. The results of these tests are presented below in Table 1.

TABLE 1

Effect of Alloy Composition of Magnesium Alloys on Adhesion When Using "Etch-free" Pre-Treatment Process

| Alloy composition | Processed by Immersion | Processed Electrolytically |
|---|---|---|
| Mg6Al (AM 60) | Generally good adhesion | Generally good adhesion |
| Mg8Al1Zn | Poor adhesion | Poor adhesion |
| Mg8Al4Zn | Excellent adhesion | Excellent adhesion |
| Mg2Al6Zn | Generally good adhesion | Excellent adhesion |
| Mg6Al8Zn | Fairly poor adhesion | Excellent adhesion |
| Mg4Al12Zn (ZA 124) | Poor adhesion | Excellent adhesion |
| Mg18Zn | Poor adhesion | Excellent adhesion |
| Mg3Al12.5Zn (AM Lite) | Poor adhesion | Excellent adhesion |

The above table clearly demonstrates that as the zinc content of the alloy increases, the adhesion obtained by immersion decreases. The table also illustrates the wide range of alloys that can be processed using the electrolytic process of the invention.

Comparison of the adhesion values obtained from AZ91 and Mg8Al4Zn illustrates that the inclusion of zinc in the alloy dramatically increases the adhesion levels obtained from alloys containing a higher percentage of aluminum.

Finally, the results obtained on the AM 60 alloy illustrate that in the case of low zinc alloys, improved results are obtained at a lower aluminum content.

What is claimed is:

1. A method of depositing an adherent plated deposit onto a magnesium alloy article, the method comprising the steps of:

(a) cleaning the magnesium alloy article in an alkaline cleaning solution which has a pH above 10;

(b) applying a zinc layer on the cleaned magnesium alloy article by electrodeposition in a zinc coating solution through the application of electrical current; and (c) applying a metal coating from an electrolyte solution that is compatible with the zinc coated magnesium surface, wherein the magnesium alloy contains about 0-9% aluminum and about 6-20% zinc, and wherein the article is not etched prior to the applying of the zinc layer.

2. The method according to claim 1, wherein the zinc coating solution is an aqueous solution comprising:

an alkali metal pyrophosphate;

a zinc salt; and a water soluble fluoride salt or hydrofluoric acid.

3. The method according to claim 2, wherein the alkali metal pyrophosphate is present in the solution in an amount sufficient to provide about 6 to 270 g/l or pyrophosphate ion.

4. The method according to claim 2, wherein the zinc salt is present in the solution in an amount sufficient to provide about 1 to 40 g/l zinc ions.

5. The method according to claim 2, wherein the fluoride salt or hydrofluoric acid is present in the solution in an amount sufficient to provide about 2-80 g/l fluoride ions.

6. The method according to claim 1, wherein the zinc layer is applied electrolytically using a cathodic current density of about 0.5 to 5.0 $A/dm^2$.

7. The method according to claim 6, wherein the cathodic current density is between about 0.5-2.0 $A/dm^2$.

8. The method according to claim 2, wherein the zinc coating solution has a pH between about 8 and 11.

9. The method according to claim 2 wherein the temperature of the zinc coating solution is between about 10-100° C.

10. The method according to claim 9, wherein the temperature of the zinc coating solution is between about 40-65° C.

11. The method according to claim 1, wherein the magnesium alloy has an aluminum content of less than about 6%.

* * * * *